US009796069B2

(12) United States Patent
Howell, Jr.

(10) Patent No.: US 9,796,069 B2
(45) Date of Patent: Oct. 24, 2017

(54) LED LIGHT INSTALLATION DEVICE

(71) Applicant: Eddie Howell, Jr., Newport News, VA (US)

(72) Inventor: Eddie Howell, Jr., Newport News, VA (US)

( * ) Notice: Subject to any disclaimer, the term of this patent is extended or adjusted under 35 U.S.C. 154(b) by 336 days.

(21) Appl. No.: 14/640,134

(22) Filed: Mar. 6, 2015

(65) Prior Publication Data

US 2016/0258604 A1 Sep. 8, 2016

(51) Int. Cl.

| | |
|---|---|
| ***F21V 19/04*** | (2006.01) |
| ***B25B 13/50*** | (2006.01) |
| ***B25B 13/48*** | (2006.01) |
| ***H01J 9/00*** | (2006.01) |
| ***F21V 29/77*** | (2015.01) |
| ***F21K 9/23*** | (2016.01) |

(52) U.S. Cl.
CPC ..... *B25B 13/50* (2013.01); *B25B 13/481* (2013.01); *F21K 9/23* (2016.08); *F21V 29/77* (2015.01); *H01J 9/003* (2013.01)

(58) Field of Classification Search
CPC .. H01J 9/003; H01J 9/006; H01K 3/32; B25B 13/50; B25B 13/481; F21V 21/36; F21V 19/04; F21V 19/001
See application file for complete search history.

(56) References Cited

U.S. PATENT DOCUMENTS

| | | | | |
|---|---|---|---|---|
| 4,663,996 | A * | 5/1987 | Grudgfield | H01K 3/32 294/99.1 |
| 4,719,826 | A | 1/1988 | DuBois | |
| 5,809,850 | A | 9/1998 | Tickner | |
| 6,257,095 | B1 | 7/2001 | Yukness | |
| D490,670 | S | 6/2004 | Ball et al. | |
| 7,197,962 | B2 * | 4/2007 | Williams | B25J 15/10 81/3.42 |
| 8,555,749 | B2 | 10/2013 | Gatski | |
| 8,646,362 | B2 | 2/2014 | Schildmeier | |
| 8,875,600 | B1 * | 11/2014 | Ely | H01J 9/003 81/53.11 |
| 9,070,544 | B1 * | 6/2015 | Shaps | H01K 3/32 81/53.11 |
| 2004/0206210 | A1 | 10/2004 | Tryba | |
| 2015/0316237 | A1 * | 11/2015 | Gurwicz | B25B 13/48 29/854 |

FOREIGN PATENT DOCUMENTS

| | | |
|---|---|---|
| WO | WO2006100482 | 9/2006 |

* cited by examiner

*Primary Examiner* — David B Thomas

(57) ABSTRACT

An LED light installation device facilitates removal and installation of LED type lights into can light housings in an elevated position. The device includes a collar having a first end. The first end is open wherein the collar is configured for receiving an extension pole into the first end. A plate is coupled to a second end of the collar. The plate has a planar upper surface. Each of a plurality of projections is coupled to and extends outwardly from the upper surface of the plate wherein the projections are configured for extending through gaps in a heat sink portion of an LED light when the LED light rests on the upper surface of the plate.

10 Claims, 3 Drawing Sheets

LED LIGHT INSTALLATION DEVICE

BACKGROUND OF THE DISCLOSURE

Field of the Disclosure

The disclosure relates to light installation devices and more particularly pertains to a new light installation device for facilitating removal and installation of LED type lights into can light housings in an elevated position.

SUMMARY OF THE DISCLOSURE

An embodiment of the disclosure meets the needs presented above by generally comprising a collar having a first end. The first end is open wherein the collar is configured for receiving an extension pole into the first end. A plate is coupled to a second end of the collar. The plate has a planar upper surface. Each of a plurality of projections is coupled to and extends outwardly from the upper surface of the plate wherein the projections are configured for extending through gaps in a heat sink portion of an LED light when the LED light rests on the upper surface of the plate.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
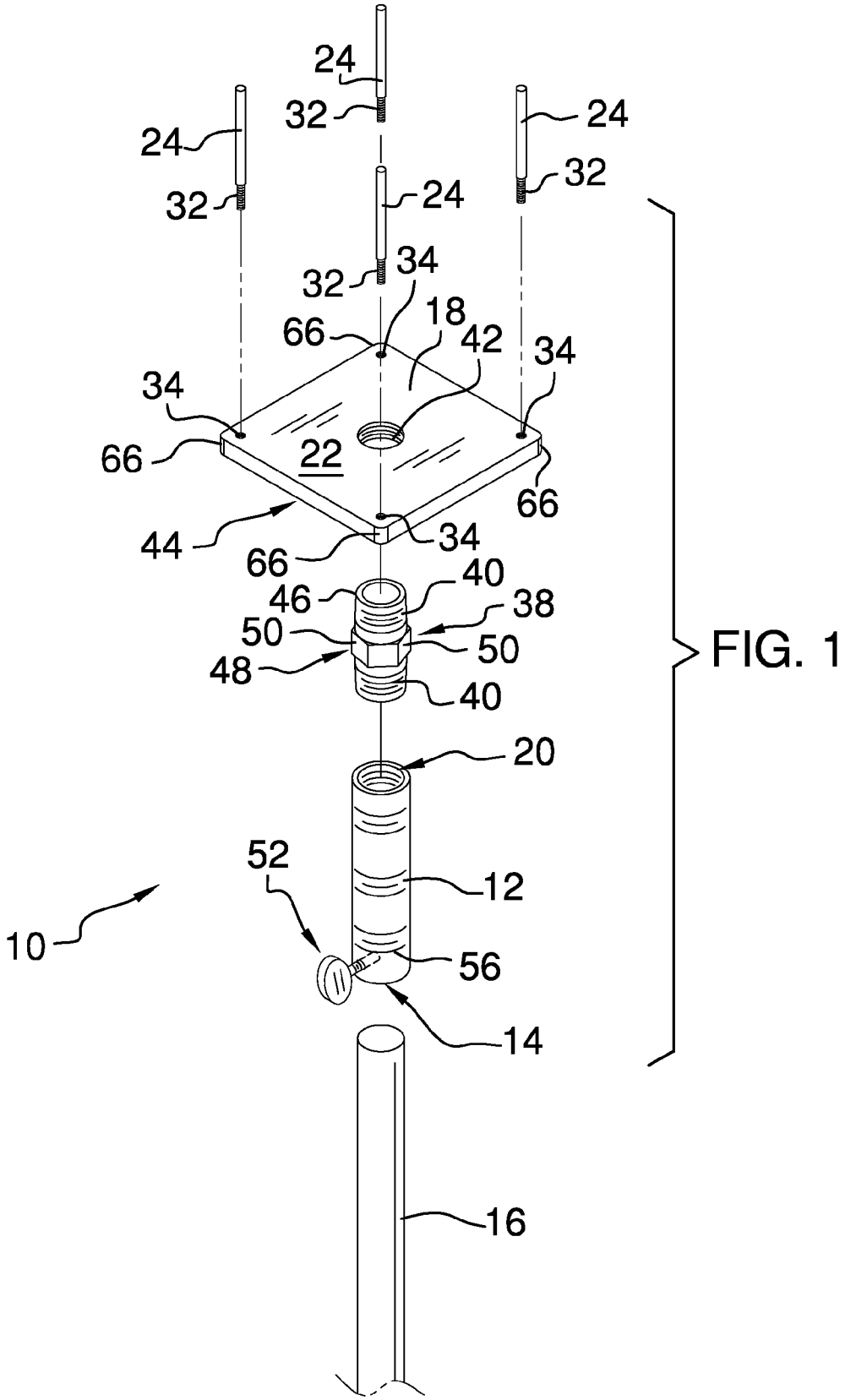
FIG. 1 is an exploded top front side perspective view of a LED light installation device according to an embodiment of the disclosure.
Figure 2:
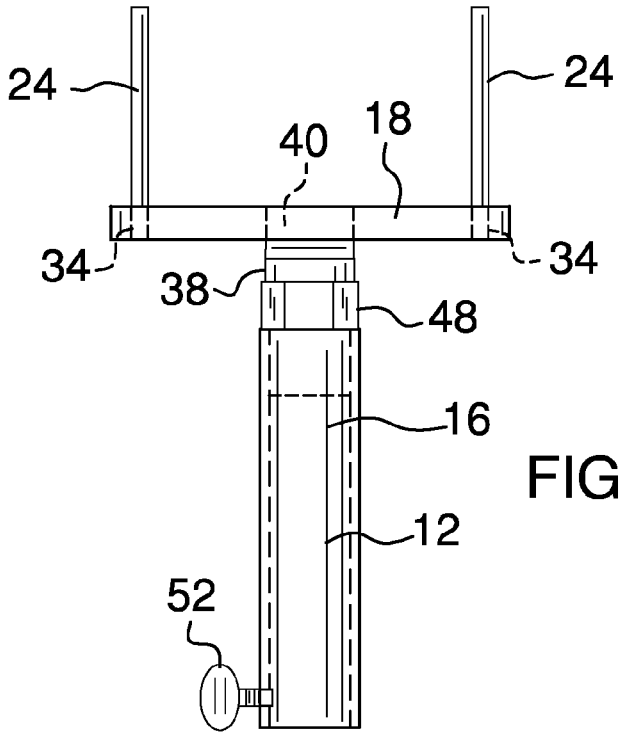
FIG. 2 is a front view of an embodiment of the disclosure.
Figure 3:
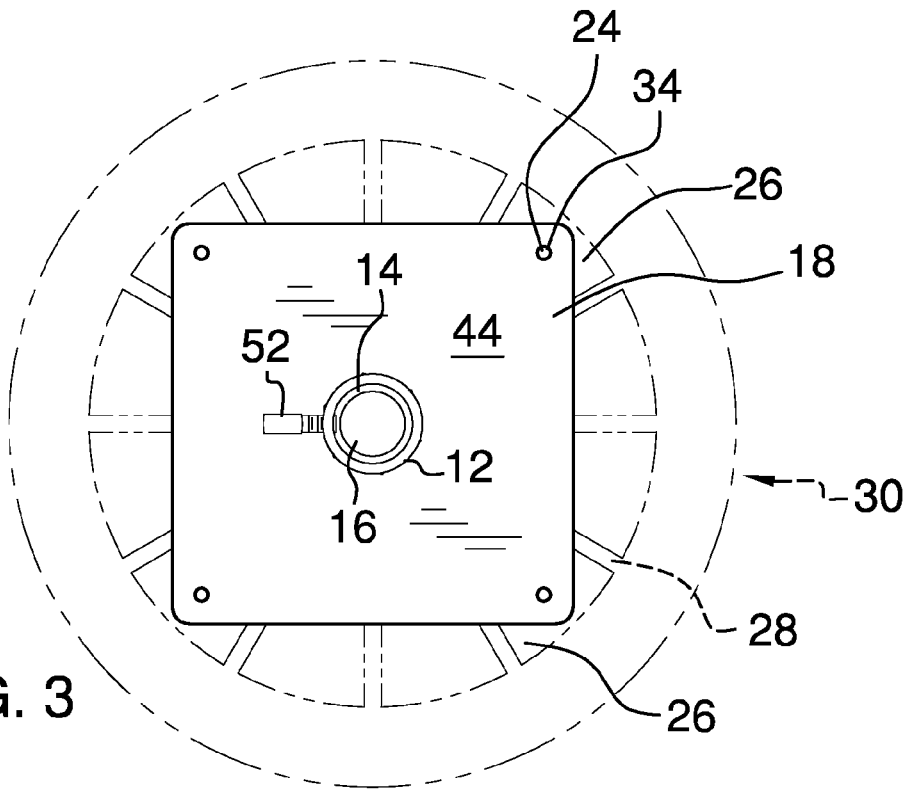
FIG. 3 is a bottom view of an embodiment of the disclosure.
Figure 4:
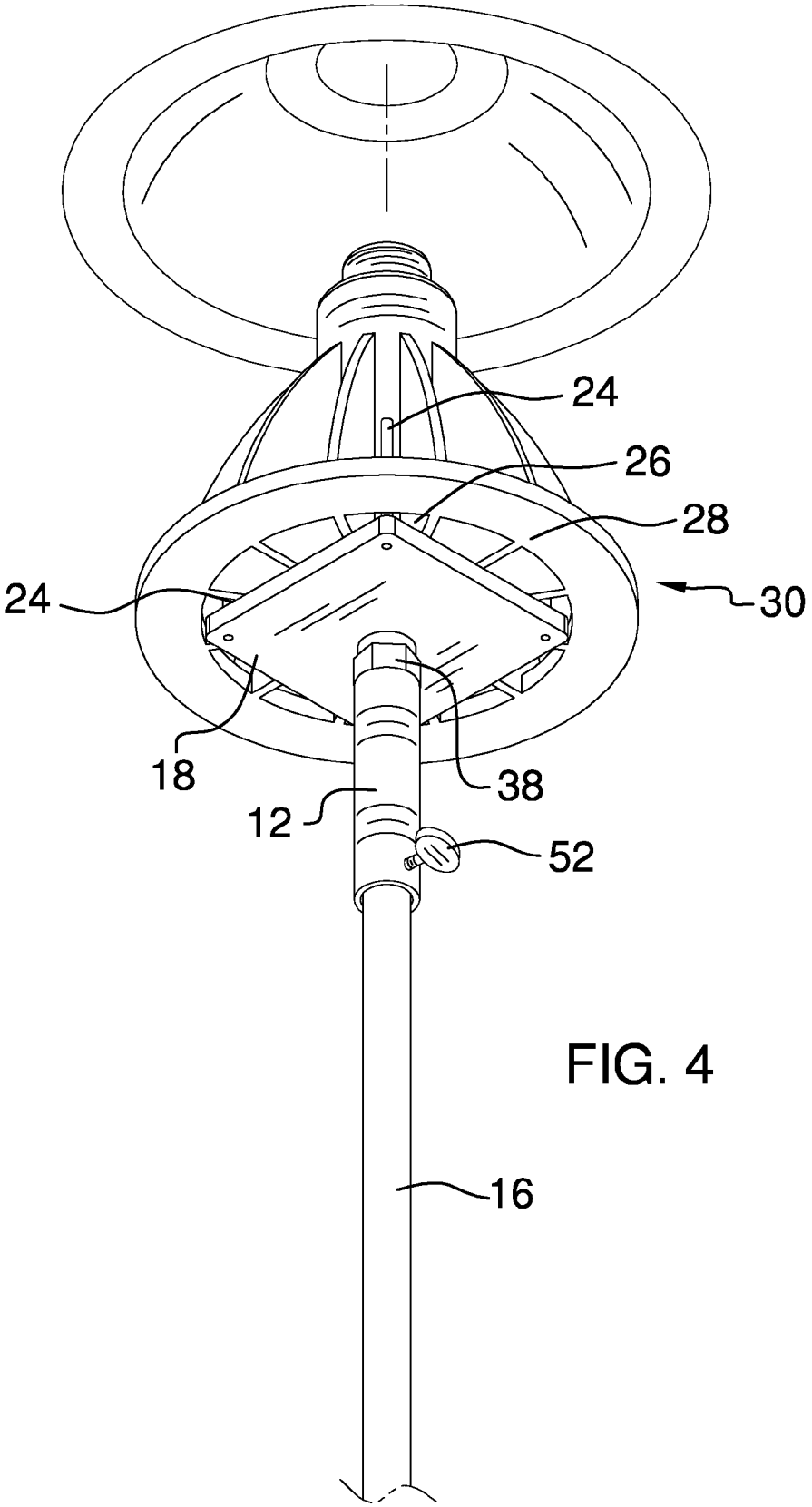
FIG. 4 is a bottom front side perspective view of an embodiment of the disclosure in use.

With reference now to the drawings, and in particular to FIGS. 1 through 4 thereof, a new light installation device embodying the principles and concepts of an embodiment of the disclosure and generally designated by the reference numeral 10 will be described.

As best illustrated in FIGS. 1 through 4, the LED light installation device 10 generally comprises a collar 12 having a first end 14. The first end 14 is open wherein the collar 12 is configured for receiving an extension pole 16 into the first end 14. A plate 18 is coupled to a second end 20 of the collar 12. The plate 18 has an upper surface 22. The upper surface 22 is planar. Each of a plurality of projections 24 is coupled to and extends outwardly from the upper surface 22 of the plate 18 such that the projections 24 are configured for extending through gaps 26 in a heat sink portion 28 of an LED light 30. The LED light 30 rests on the upper surface 22 of the plate 18 and the projections 24 extend through the gaps 26 engaging the heat sink portion 28 when the collar 12 is rotated. Each of the projections 24 is removable from the plate 18. The projections 24 extend transversely from the upper surface 22 of the plate 18. Each of the projections 24 extends from the plate 18 proximate a respective corner 66 of the plate 18. Each of the projections 24 has a threaded bottom portion 32 threadingly engageable to an associated threaded hole 34 extending into the upper surface 22 of the plate 18.

A coupler 38 may be provided having a pair of threaded end sections 40 in the manner of a nipple. The second end 20 of the collar 12 is open and threaded wherein the coupler 38 is couplable to the second end 20 of the collar 12. A central aperture 42 extends into a bottom surface 44 of the plate 18. The central aperture 42 is threaded wherein the coupler 38 is couplable to the plate 18 such that the plate 18 is also coupled to the collar 12. The central aperture 42 extends fully through the plate 18 and an end face 46 of the coupler 38 is flush with the upper surface 44 of the plate 18. A medial section 48 of the coupler 38 has a plurality of planar faces 50 parallel to a longitudinal axis of the coupler 38 wherein a cross-sectional shape of the medial section 48 transverse to the longitudinal axis is polygonal.

A locking member 52 is coupled to the collar 12. The locking member 52 is extendable through a wall 56 of the collar and into a cavity formed by the open first end 14 wherein the locking member 52 is configured to secure the collar 12 to the extension pole 16. The locking member 52 may be a thumbscrew or the like.

In use, the projections 24 are inserted into the gaps 26 and the extension pole 16 is rotated to remove or install the LED light 30 in an elevated position. The projections 24 engage the LED light 30 within an outer perimeter of the LED light 30 wherein the device 10 facilitates installation and removal of the LED light 30 from can type light housings.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An LED light installation device comprising:

a collar having a first end, said first end being open wherein said collar is configured for receiving an extension pole into said first end;

a plate coupled to a second end of said collar, said plate having an upper surface, said upper surface being planar; and a plurality of projections coupled to and extending outwardly from said upper surface of said plate wherein said projections are configured for extending through gaps in a heat sink portion of an LED light when the LED light rests on said upper surface of said plate, each of said projections being removable from said plate.

2. The device of claim 1, further comprising said projections extending transversely from said upper surface of said plate.

3. The device of claim 1, further comprising a locking member coupled to said collar, said locking member being extendable into said open first end wherein said locking member is configured to secure said collar to the extension pole.

4. The device of claim 1, further comprising each of said projections having a threaded bottom portion threadingly engageable to an associated threaded hole extending into said upper surface of said plate.

5. The device of claim 1, further comprising:

said projections extending transversely from said upper surface of said plate, each of said projections extending from said plate proximate a respective corner of said plate, each of said projections having a threaded bottom portion threadingly engageable to an associated threaded hole extending into said upper surface of said plate;

a coupler having a pair of threaded end sections;

a second end of said collar being open and threaded wherein said coupler is couplable to said second end of said collar;

a central aperture extending into a bottom surface of said plate, said central aperture being threaded wherein said coupler is couplable to said plate such that said plate is coupled to said collar, said central aperture extending fully through said plate;

an end face of said coupler being flush with said upper surface of said plate;

a medial section of said coupler having a plurality of planar faces parallel to a longitudinal axis of said coupler wherein a cross-sectional shape of said medial section transverse to the longitudinal axis is polygonal; and a locking member coupled to said collar, said locking member being extendable into said open first end wherein said locking member is configured to secure said collar to the extension pole.

6. An LED light installation device comprising:

a collar having a first end, said first end being open wherein said collar is configured for receiving an extension pole into said first end;

a plate coupled to a second end of said collar, said plate having an upper surface, said upper surface being planar, said plate being square; and a plurality of projections coupled to and extending outwardly from said upper surface of said plate wherein said projections are configured for extending through gaps in a heat sink portion of an LED light when the LED light rests on said upper surface of said plate.

7. The device of claim 6, further comprising each of said projections extending from said plate proximate a respective corner of said plate.

8. An LED light installation device comprising:

a collar having a first end, said first end being open wherein said collar is configured for receiving an extension pole into said first end;

a plate coupled to a second end of said collar, said plate having an upper surface, said upper surface being planar;

a plurality of projections coupled to and extending outwardly from said upper surface of said plate wherein said projections are configured for extending through gaps in a heat sink portion of an LED light when the LED light rests on said upper surface of said plate;

a coupler having a pair of threaded end sections;

a second end of said collar being open and threaded wherein said coupler is couplable to said second end of said collar; and a central aperture extending into a bottom surface of said plate, said central aperture being threaded wherein said coupler is couplable to said plate such that said plate is coupled to said collar.

9. The device of claim 8, further comprising a medial section of said coupler having a plurality of planar faces parallel to a longitudinal axis of said coupler wherein a cross-sectional shape of said medial section transverse to the longitudinal axis is polygonal.

10. The device of claim 8, further comprising:

said central aperture extending fully through said plate; and an end face of said coupler being flush with said upper surface of said plate.

* * * * *